US006367554B1

(12) United States Patent
Theiss

(10) Patent No.: US 6,367,554 B1
(45) Date of Patent: Apr. 9, 2002

(54) RISER METHOD AND APPARATUS

(75) Inventor: David H. Theiss, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/579,608

(22) Filed: May 26, 2000

(51) Int. Cl.[7] ..... E21B 7/128

(52) U.S. Cl. ..... 166/365; 166/367; 405/224.2

(58) Field of Search ..... 166/365, 350, 166/351, 359, 367, 368, 378, 380; 405/195.1, 224.2, 303

(56) References Cited

U.S. PATENT DOCUMENTS

| | | | | |
|---|---|---|---|---|
| 3,435,906 A | | 4/1969 | Nicolson | 175/7 |
| 3,789,921 A | | 2/1974 | DeChassy et al. | 166/5 |
| 4,147,221 A | | 4/1979 | Ilfrey et al. | 175/7 |
| 4,167,215 A | | 9/1979 | Thorne | 166/341 |
| 4,190,120 A | | 2/1980 | Regan | 175/7 |
| 4,230,186 A | | 10/1980 | Lewis, Jr. | 166/342 |
| 4,437,521 A | | 3/1984 | Richardson et al. | 166/341 |
| 4,478,287 A | * | 10/1984 | Hynes et al. | 166/341 |
| 4,554,976 A | * | 11/1985 | Hynes et al. | 166/341 |
| 4,626,135 A | * | 12/1986 | Roche | 405/195.1 |
| 4,662,785 A | * | 5/1987 | Gibb et al. | 405/195.1 |
| 5,377,762 A | | 1/1995 | Turner | 166/399 |

FOREIGN PATENT DOCUMENTS

| | | | | |
|---|---|---|---|---|
| GB | 2091317 A | * | 7/1982 | 166/367 |
| GB | 2156407 A | * | 10/1985 | 166/367 |
| GB | 2178090 A | * | 2/1987 | 166/367 |
| WO | WO 00/34619 | | 6/2000 | E21B/19/00 |

OTHER PUBLICATIONS

Cooper Cameron Corporation; *Free–Standing Drilling Riser System*; Brochure Printed 4/99; (4 p.).

Cooper Cameron Corporation; *Deepwater High Capacity Collet Connector*; Bochure Printed 2/98: (4 p.)

Cooper Cameron Corporation; *Subsea Wellheads for Deep and Shallow Water Applications*; Brochure Printed 7/98; (8 p.).

Cooper Cameron Corporation; *1998 –1999 Cameron Catalog*; Printed 3/98; (7 p.).

* cited by examiner

*Primary Examiner*—Frank S. Tsay
(74) *Attorney, Agent, or Firm*—Conley Rose & Tayon, P.C.

(57) ABSTRACT

The riser system includes a small diameter riser that can be disconnected from the subsea BOP/wellhead assembly to obtain access to the wellbore for large diameter casing while continuously maintaining a hydrostatic head to control the well. The riser system further includes a large diameter riser joint having one end connected to the BOP/wellhead assembly and one or more hydraulic conduits extending from the BOP/wellhead assembly to the small diameter riser which extends to the surface. The small diameter riser has a first position where the small diameter riser is aligned and connected to the other end of the riser joint and a second position where the small diameter riser is non-aligned and unconnected with the large diameter riser joint. The riser system further includes a shifter which moves the small diameter riser from the first position to the second position. Downhole operations are conducted through the small diameter riser in the first position. When it is necessary to have a larger diameter access to the well, the shifter is actuated to move the small diameter riser to the second position allowing access to the well through the large diameter riser joint and BOP/wellhead assembly.

34 Claims, 3 Drawing Sheets

SECTION A-A

RISER METHOD AND APPARATUS

CROSS-REFERENCE TO RELATED APPLICATIONS

Not Applicable.

TECHNICAL FIELD OF THE INVENTION

The present invention relates generally to marine riser systems and more particularly to a riser system having a small diameter riser that can be shifted to one side to allow access into and out of a well with large diameter casing, casing hangers and seal assemblies. Still more particularly, the present invention relates to a shiftable riser connection that continuously provides fluid communication between the well and the surface throughout the shifting operation and while accessing the large diameter borehole below the small diameter riser.

BACKGROUND OF THE INVENTION

Drilling operations for the recovery of offshore deposits of crude oil and natural gas are taking place in deeper and deeper waters. Drilling operations in deeper waters are typically carried out from floating vessels rather than from stationary platforms resting on the ocean floor and commonly used in shallow water. According to conventional procedures, a drilling vessel is dynamically stationed, or moored, above a well site on the ocean floor. After a wellhead has been established, a blowout preventer (BOP) stack is mounted on the well head to control the pressure at the surface.

Subsea wells are typically drilled with multiple boreholes having decreasing diameters as the wellbore extends deeper into the earth. Each borehole is lined with a casing string that extends into the borehole from a wellhead and is cemented within the borehole. The drilling, casing installation and cementing is performed through one or more risers that extend from the wellhead to the surface, such as to a floating drilling vessel.

A riser pipe extends from the floating vessel to the wellhead equipment on the ocean floor to conduct downhole operations. The riser is attached to the wellhead equipment and is supported in tension at or near the water surface so as to prevent its collapse. In drilling the borehole for the well, a drill string is passed from the floating vessel down through the riser and wellhead equipment and into the borehole.

By way of example, a 21 inch riser usually extends from a blowout preventer (BOP) stack mounted on the wellhead on the sea floor to the drilling platform on the drilling vessel at the surface. Typically, the BOP stack has a 18-¾ inch nominal bore and is commonly used for rilling operations in almost any water depth from a floating vessel. The 21 inch riser typically has an outside diameter (OD) of nominally 21 inches and an inside diameter (ID) of nominally 19 inches. Thus operations are conducted through the 19 inch ID of the 21 inch riser and the bore of the BOP stack.

Generally the largest casing string installed in the wellbore is 16 inch OD casing and then after drilling the next borehole, a 13-⅜ inch OD casing is installed. Typically the next casing string to be installed is a 10-¾ inch OD casing or alternatively a 9-⅝ inch OD casing. The next casing string to be run is typically either a 7 or 7-⅝ inch OD casing.

When the casing extends to a depth where it will encounter substantial downhole pressures, the casing string must be run into the wellbore under well controlled conditions, i.e. through a drilling riser and BOP stack. The 13-⅜ inch casing typically reaches such depths and requires well control. Thus, the BOP stack must be large enough to accommodate the new casing string, such as a 13-⅜ inch casing, that is to be installed under well control. A 16 inch riser will accommodate casing, casing hangers and well tools having an OD of up to 13-½ inches and thus a 16 inch riser will allow the passage of a 10-¾ inch OD casing and smaller. Neither a 16 or 13-⅜ inch casing string will pass through a 16 inch OD riser so a 21 inch riser may be required.

Wells are being drilled in deeper water, such as to depths of 10,000 feet, causing difficulties in using 21 inch risers. Because of the current drag forces and the weight of a 21 inch riser which is several thousand feet long and full of drilling mud, the large diameter riser becomes very unwieldy particularly in an ocean environment. The riser is maintained in tension from the floating drilling vessel and thus where a large diameter riser is several thousand feet long, the amount of tension that must be applied to the riser requires a very high tension force at the top of the riser on the vessel. This necessitates that the riser have increased strength to handle the increased tension thereby requiring that the thickness of the wall of the riser be increased which in turn increases the weight of the riser. The more weight that is required, the greater the tension that is required. Thus, the problem becomes greater as the length and size of the riser increases.

The floating drilling vessel must accommodate the riser required for downhole operations. Thus, the vessel must be specially equipped to handle large diameter risers and their associated large tension loads in deep water.

The drilling operation must be conducted through a riser which is large enough to accommodate the drill bit, the casing hangers, the seal assemblies and also provide an annulus around the new casing which is large enough to set and cement the casing. Typically, the drill pipe is 5 inch or 5-½ inch OD pipe with the larger 5-½ inch OD drill pipe typically being used in deeper water. Although typically the first bit into the well is a 17-½ inch bit, an expanding bit, such as an underreamer, hole opener, or bi-center bit, maybe used where the bit has a smaller OD to pass through a small diameter riser. Once in the borehole, the bit will drill a larger diameter borehole.

Drilling mud is circulated down through the drill string and returned to the vessel through the annulus formed between the riser and the drill pipe. It is necessary for the 21 inch riser, extending several thousand feet, to handle all of the drilling mud needed for drilling the boreholes. Because of the difference in density between the drilling mud and sea water, the large pressure created by the fluid column in the large diameter riser must be contained within the riser. The column of drilling mud can be approximately twice as heavy as sea water such that for every foot of depth, there is about one-half psi of mud gradient weight whereby at a depth of 10,000 feet, there could be 5,000 psi inside the large diameter riser relative to the sea water around the riser.

The drilling fluids in the riser also form a fluid column placing a hydrostatic head on the well for well control purposes. Well control is established by maintaining the density of the drilling fluid, and thus the hydrostatic pressure exerted on the subsurface formations, at a level that is sufficient to prevent the production fluids under pressure in the formation from overcoming the hydrostatic head. If the hydrostatic head on the well is insufficient, the pressurized gas and other formation fluids may exceed the hydrostatic head leading to a blowout, sometimes resulting in damage to property, the pollution of the ocean and loss of life.

On the other hand, if the hydrostatic head is too great, the pressure may force drilling fluids into the formation causing the loss of drilling fluids into the formation or a reduction or lost in production. If too much drilling fluid is lost into the formation and the level of drilling fluid drops in the riser, the hydrostatic head can decrease below the pressure of the formation and cause a blowout. Furthermore, the hydrostatic head may increase to an amount so as to fracture the formation resulting in increased lost circulation.

According to conventional practice, choke and kill lines typically extend from the drilling vessel to the wellhead to provide fluid communication for well control and circulation. The choke line is in fluid communication with the borehole at the wellhead and bypasses the riser to vent gases or other formation fluids directly to the surface. According to conventional practice, a surface-mounted choke valve is connected to the terminal end of the choke conduit line. The downhole back pressure can be maintained substantially in equilibrium with the hydrostatic pressure of the column of drilling fluid in the riser annulus by adjusting the discharge rate through the choke valve.

The kill line is primarily used to control the density of the drilling mud. One method of controlling the density of the drilling mud is by the injection of relatively lighter drilling fluid through the kill line into the bottom of the riser to decrease the density of the drilling mud in the riser. On the other hand, if it is desired to increase mud density in the riser, a heavier drilling mud is injected through the kill line.

In addition to the choke and kill lines, a well may be provided with a booster line, through which additional mud can be pumped to a desired location so as to increase fluid velocity above that point and thereby improve the conveyance of drill cuttings to the surface. The booster line can also be used to modify the density of the mud in the annulus. By pumping lighter or heavier mud through the booster line, the average mud density above the booster connection point can be varied. References in the discussion below to choke, kill, and booster lines will be understood to include booster lines where desired. While the choke, kill, and booster lines provide pressure control means to supplement the hydrostatic control resulting from the fluid column in the riser, the riser itself provides the primary fluid conduit to the surface.

In deep water, however, the riser is the source of several disadvantages. Because the length of the riser must approximate the depth of the water, deep-water risers are expensive and quite heavy. The drilling vessel must support the riser in tension in order to keep the riser from buckling under its own weight. The riser is subject to lateral forces from currents in the water. In addition, the volume of drilling mud necessary to fill a deep-water riser is substantial. For a 10,000 ft depth application, a 21 inch riser can require over 6000 additional gallons (over 70% more) of mud to fill than a 16 inch riser. The expense of preparing and handling the large volume of drilling mud increases the cost of the well.

If it were possible to reduce the size of the riser, the riser would be lighter and less expensive, and would be subjected to smaller current loads. The expense associated with the volume of drilling mud required to fill the riser would be correspondingly reduced. Furthermore, the reduction in the size of the riser would subsequently reduce the need to increase the drilling fluid velocity to effectively lift cuttings away from the well. However, because the riser must be large enough to allow the passage therethrough of various large diameter casing and well tools that must be passed into the wellbore, it has heretofore been impossible to utilize a riser having an inside diameter smaller than the outside diameter of these large diameter objects. Hence it is desired to provide a small diameter riser system that allows hydraulic communication with and control of a deep-water well, while simultaneously allowing access to the well by large diameter equipment. Thus, using a small diameter, riser throughout the downhole drilling operation would provide many advantages.

Other objects and advantages of the invention will appear from the following description.

SUMMARY OF THE INVENTION

The riser system of the present invention utilizes a small diameter riser while continuously providing hydraulic communication between the wellhead and surface maintaining control of a deep-water well and simultaneously allowing access to the well by large diameter equipment. The riser system allows large diameter casing and other equipment to be placed in the well even though the riser that provides fluid communication with the well during drilling has a smaller inside diameter than that of the outside diameter of the equipment. The riser system further allows access to the well by the large diameter equipment without requiring that the small diameter riser be emptied of drilling mud, that the well be filled with extra-dense mud, or that fluid communication with the well be suspended.

More particularly, the riser system provides a partial disconnect between the riser and the well so that the riser can be closed to retain the column of drilling fluid therein while still allowing fluid communication with the well. According to one preferred embodiment, when it is desirable to provide large diameter access to the well, the small diameter riser is disconnected from a large diameter riser joint connected to the BOP stack and well. Choke, kill and booster lines remain connected and open to fluid communication between the flowbore of the small diameter riser and the well. One or more flexible connections are provided to allow the disconnected riser to shift laterally away from the large diameter riser joint. According to a preferred embodiment, hydraulic rams push against the riser joint and choke, kill and booster lines to shift the small diameter riser apart, thus providing room for access to the large diameter riser joint for installing large diameter equipment such as casing into the wellbore. The same hydraulic action preferably causes a guide to align the large diameter equipment with the top of the large diameter riser joint to facilitate passage of the large diameter equipment into the wellbore.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

The present invention relates to methods and apparatus for performing downhole operations from an offshore platform through a riser system having a small diameter riser extending to a subsea wellhead while continuously maintaining fluid communication between the wellbore and the surface. Various embodiments of the present invention provide a number of different constructions and methods of operation. It is to be fully recognized that the different teachings of the embodiments discussed below may be employed separately or in any suitable combination to produce desired results.

The riser system of the present invention includes a small diameter riser that can be disconnected from the blowout preventer (BOP) to obtain access to the wellbore for large diameter casing while continuously maintaining a hydrostatic head to control the well. Further the riser system may include a large diameter riser joint having one end connected to a subsea BOP and one or more hydraulic connections extending from the BOP to the small diameter riser which extends to the surface. The small diameter riser has a first position where the small diameter riser is aligned and connected to the other end of the riser joint and a second position where the small diameter riser is non-aligned and unconnected with the large diameter riser joint. The riser system further includes a shifter which moves the small diameter riser from the first position to the second position.

In operation downhole operations are conducted through the small diameter riser in the first position. When it is necessary to have a larger diameter access to the well, the shifter is actuated to move the small diameter riser to the second position allowing access to the well through the large diameter riser joint, BOP, and wellhead.

Figure 1:
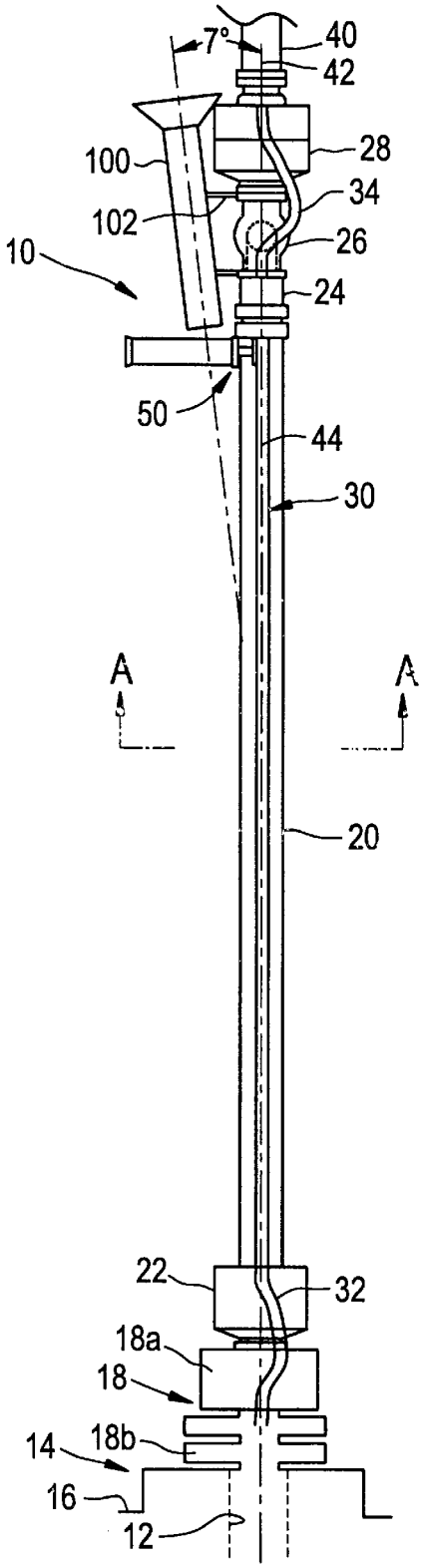
FIG. 1 is a schematic elevation view of the riser system constructed in accordance with a preferred embodiment of the present invention with the riser joint connected and aligned with the small diameter riser.

Referring initially to FIG. 1, there is shown one embodiment of the riser system 10 of the present invention in an exemplary operating environment where the downhole operation includes drilling and completing the well. A typical deep-water drilling operation is conducted from a floating drilling vessel (not shown) and more preferably from a dual activity drilling vessel having dynamic positioning. The dynamic positioning includes thrusters disposed around the vessel to maintain the vessel in position as the sea environment (wind, current, and waves) attempt to displace the vessel.

The subsea well includes a wellbore 12 extending downhole from a wellhead assembly 14 disposed on the sea floor 16. The wellhead assembly 14 includes a BOP stack 18 having an 18-¾ inch nominal bore and including one or more BOPs such as an annular BOP 18*a*, sometimes referred to as a stripper (not shown), and/or a ram-type BOP 18*b* having 4 or 5 ram cavities. The annular BOP 18*a* may be used to strip the casing into the wellbore 12. A platform on the floating vessel from which operations are conducted is positioned at the surface above the wellbore 12.

The riser system 10 includes a riser joint 20 connected to a lower flex joint 22 that is connected to the top of BOP stack 18 by a collet connector. The collet connector allows the riser joint 20 to be disconnected from BOP stack 18 should it become desirable to disconnect from BOP stack 18 due to the vessel straying off station such as due to bad weather. According to a preferred embodiment, lower flex joint 22 is used in case the riser joint 20 starts to pull off at an angle. Without lower joint 22 to allow flexure between riser joint 20 and BOP stack 18, there would be a long moment arm created by riser joint 20, which could result in failure of one or more components.

Riser joint 20 is a large diameter tubular member. Preferably riser 20 has a 21 inch OD and at least an 18-¾ ID for passing large diameter casing, casing hangers, sealing assemblies and other large diameter well equipment. Large diameter riser joint 20 has a length which is necessary to allow choke, kill, and booster lines 30, as hereinafter described, to adequately deflect to clear riser joint 20 and provide access to wellhead assembly 14.

Riser joint 20 preferably has a receptacle 92 at its upper end forming a counterbore, hereinafter described with respect to FIG. 4. The counterbore in the receptacle 92 forms a seal bore 90 for receiving seals on a seal sub 24 hereinafter described. The seal bore thus is offset from the main flowbore through riser joint 20. It is important that a new casing string being stabbed into riser joint 20 not be dragged along the seal bore 90 so as to cause severe damage.

A plurality of choke, kill, and booster lines 30 extend around lower flex joint 22 and are connected at their lower ends to the top of lower flex joint 22 and are connected at their upper ends to the seal sub 24. Seal sub 24 is disposed on the lower end of a valve 26, which has its upper end connected to an upper flex joint 28. Valve 26 may be a simple valve, such as a gate valve or ball valve. An annular BOP or a BOP with blind rams may be disposed adjacent valve 26 or alternatively in place of valve 26. Any suitable alternative mechanism can be used to close off the lower end of a small diameter riser 40, hereinafter described.

The small diameter riser 40 is connected to upper flex joint 28 and extends to the platform on the floating drilling vessel. Lower hose lines 32 extend between the lower ends of choke, kill, and booster lines 30 and BOP stack 18, such as below annular BOP 18*a* to provide fluid communication between the flowbores of choke, kill, and booster lines 30 and the well bore 12. Upper hose lines 34 extend between the upper ends of choke, kill, and booster lines 30 and the lower end of small diameter riser 40 to provide fluid communication between the flowbores of choke, kill, and booster lines 30 and the flowbore of small diameter riser 40. Hose lines 32, 34 are preferably constructed to accommodate high pressure fluids. It should be appreciated lines 32, 34 and choke, kill, and booster lines 30 provide a fluid connection between wellbore 12 and small diameter riser 40 and provide an alternative flow path around riser joint 20. Lines 32, 34 have slack allowing the flexure of lower and upper flex joints 22, 28 without damaging lines 32, 34.

In laterally shifting the choke, kill, and booster lines 30, it may be desirable to have at least one of the booster lines 66, 68 (see FIG. 3) be connected below the annular BOP 18 to communicate with the wellbore 12. This permits circulation through that booster line in the shifted position shown in FIG. 2. The booster line links the wellbore below the annular BOP 18*a* with the small diameter riser 40 extending to the surface. However, that may or may not be necessary, as choke, kill, and booster lines 30 generally communicate with the wellbore 12 below BOPs 18*a* and 18*b* and include valves for opening and closing the choke, kill, and booster lines 30 for circulation downhole.

Choke, kill, and booster lines 30 preferably are adjacent and extend longitudinally down the sides of riser joint 20 and are preferably arranged so that they are co-planar, i.e. lie in the same plane. They may be adjacent one or both sides of riser joint 20. If the various choke, kill, and booster lines 30 are not co-planar, it is preferred that they are mechanically joined such that a lateral force applied simultaneously causing the lines 30 to move laterally together. Choke, kill, and booster lines and booster lines 30 are preferably made of high strength steel, with a yield strength upwards of 80,000 pounds per square inch (psi). In some instances, it may be desirable to make the walls of lines 30 thicker so as to better enable them to withstand the tension needed to retain small diameter riser 40. Alternatively, if additional tension capacity is required, a solid rod (not shown) can be run from BOP stack 18 to seal sub 24 or valve 26. In this instance, it is preferable to provide one rod on each side of riser 40, so that the tension is balanced. The rods are preferably arranged so they are coplanar with the choke, kill, and booster lines 30. It is preferred that any such rod(s) have a lower moment of inertia than riser joint 20.

It should be appreciated that the choke, kill, and booster lines 30 and/or solid rods carry the entire axial tension load on small diameter riser 40 since riser 40 is not connected to riser joint 20. The small diameter riser 40 must be maintained in tension so that there is no compression at its lower end which would cause it to buckle and to prevent small diameter riser 40 from buckling while full of drilling mud. Therefore it is preferable that the cross-sectional metal area of choke, kill, and booster lines 30 be substantially the same as cross-sectional metal area of riser joint 20 and riser 40. Although the cross-sectional area is comparable, the lines 30 are much less stiff. Because they have a comparable cross-sectional area, lines 20 can handle the same tension as that of riser joint 20 and riser 40.

Figure 2:
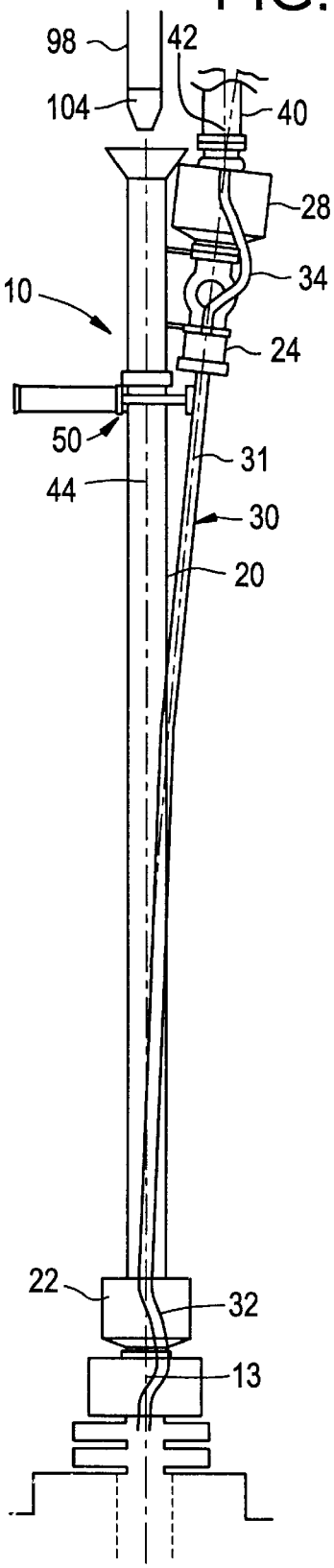
FIG. 2 is a schematic elevation view of the riser system of FIG. 1 in which a shifter of the riser system has been activated to shift the small diameter riser to one side of the large diameter riser joint.
Figure 3:
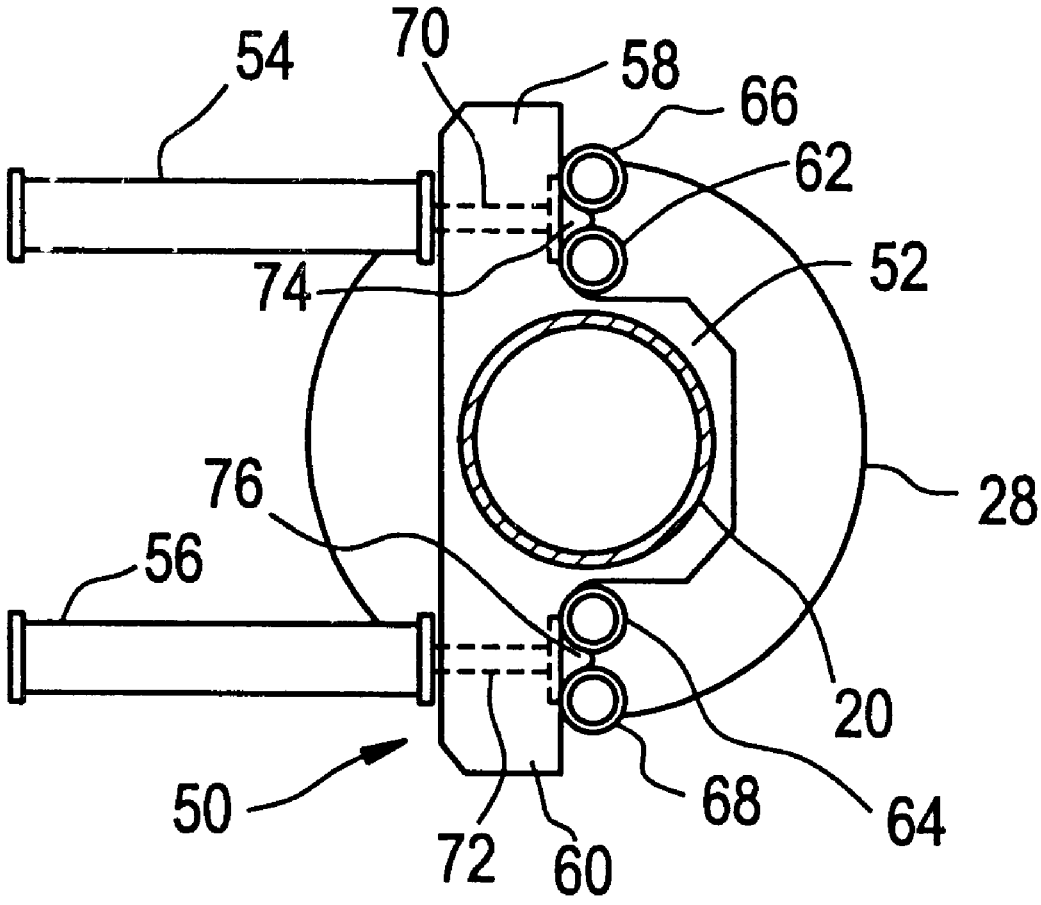
FIG. 3 is a cross-sectional view taken at plane A—A in FIG. 2 showing the shifter.

Referring now to FIGS. 1–3, the riser system 10 further includes a shifter 50 for shifting the axis 42 of small diameter riser 40 to a position where the small diameter riser axis 42 is non-aligned with the axis 44 of riser joint 20 as shown in FIG. 2. FIG. 1 shows axes 42, 44 in alignment. The shifter 50 for use in this application and constructed in accordance with a preferred embodiment is best shown in FIG. 3 and includes a yoke or flange 52 affixed around riser joint 20 adjacent its upper end. A pair of hydraulic cylinders 54, 56 are mounted on the outboard portions 58, 60, respectively, projecting from flange 52. Lines 30 preferably include a choke line 62, a kill line 64, and one or more booster lines 66, 68 which are mounted in pairs on each side of riser joint 20. Outboard portions 58, 60 serve as a cradle for choke, kill, and booster lines 30. Hydraulic cylinders 54, 56 include piston members 70, 72 extending therefrom which are hydraulically actuable. Each piston member 70, 72 has a piston head 74, 76, respectively, engaging one of the sets of choke, kill, and booster lines 30 allowing piston members 70, 72 to bear on lines 30. Piston members 70, 72 are preferably not attached to lines 30 allowing heads 74, 76 to pivot on lines 30 as shifter 50 shifts lines 30. It should be appreciated that lines 30 may all be mounted on a frame which extends around riser joint 20 such that piston members 70, 72 bear on the frame. When piston members 70, 72 retract, lines 30 move back against the yoke 52 as a result of the tension in lines 30 and their own tendency to straighten.

It should be appreciated that other apparatus and methods may be provided to move small diameter riser 40 away from riser joint 20. For example, choke, kill, and booster lines 30 may be pulled away from riser joint 20. Further, other apparatus and methods may be provided to maintain fluid communication between riser 40 and wellbore 12 while maintaining tension on riser 40. For example, small diameter riser 40 may be connected directly with the wellhead assembly 14 with flexible conduits providing fluid communication between riser 40 and wellhead assembly 14. A sliding track may allow riser 40 to be moved to one side while still maintaining its connection to wellhead assembly 14 permitting tension still to be applied to riser 40. A still further apparatus and method may be provided whereby flexible conduits continue to provide fluid communication between riser 40 and wellhead assembly 14 while the small diameter riser 40 is disconnected from wellhead assembly and suspended by the drilling vessel adjacent the wellhead assembly 14 allowing access to the wellbore 12. A dual activity rig with dynamic positioning would be used.

Figure 4:
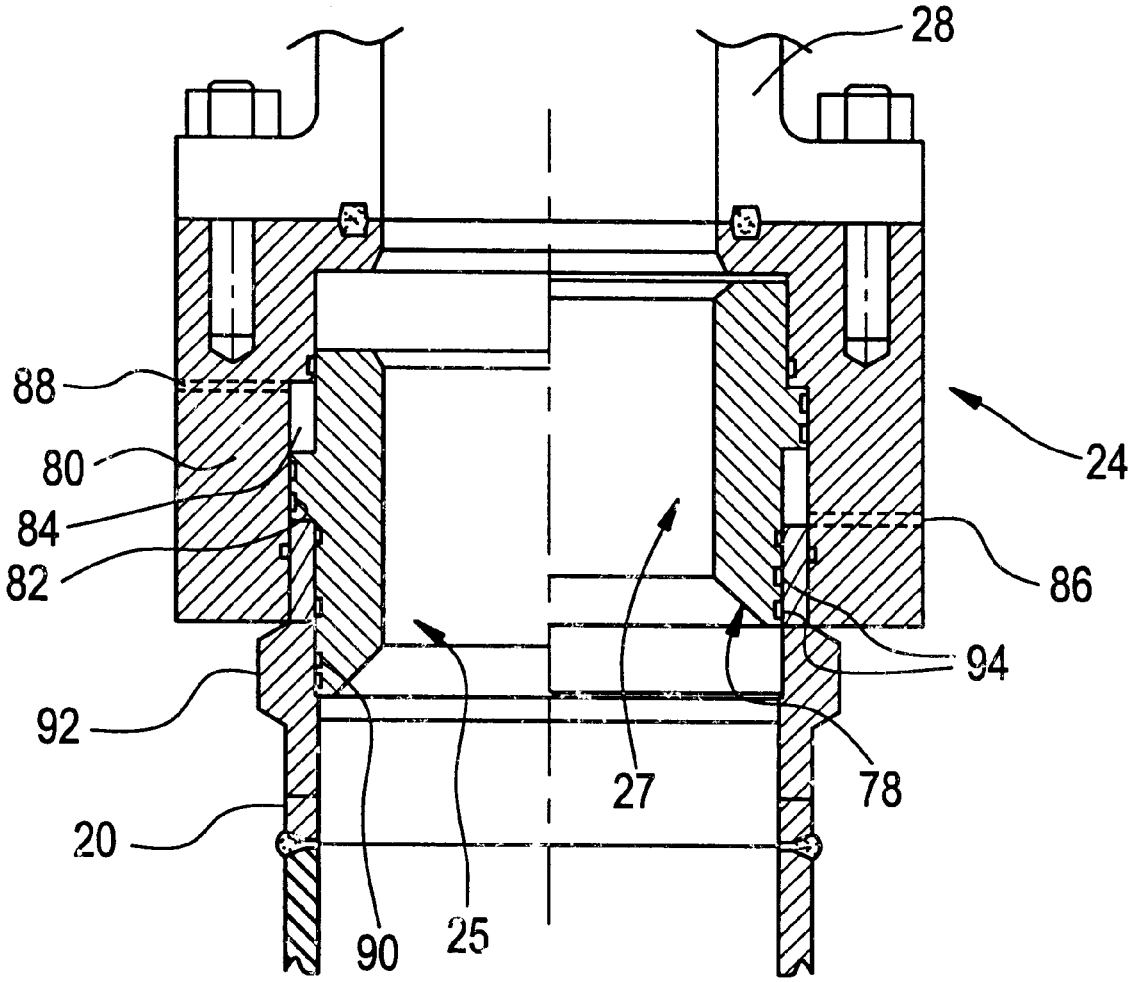
FIG. 4 is an enlarged cross-sectional view of a seal sub for sealingly connecting the large diameter riser joint with the small diameter riser in the position shown in FIG. 1.

Referring now to FIG. 4, there is shown a split schematic drawing of the seal sub 24 disposed on the lower end of valve 28 and aligned with riser joint 20. Seal sub 24 includes a seal tube 78 reciprocably disposed within the cylindrical housing 80 of seal sub 24. Seal tube 78 includes an annular piston 82 extending into an annular cylinder 84 in housing 80 which also has upper and lower hydraulic fluid ports 86, 88 for actuating annular piston 82. Seal tube 78 may be actuated between a contracted position 27 within housing 80 and an extended and sealing position 25, as shown in FIG. 4, where seal tube 78 extends into the seal bore 90 of a receptacle 92 on the upper terminal end of riser joint 20. Seal tube 78 includes annular grooves with sealing members 94 which sealing engage the sealing surface of seal bore 90. The seal sub 24 is hydraulically actuated to sealingly connect the riser joint 20 with small diameter riser 40 as shown in FIG. 1. The hydraulic mechanism to retract the seal tube 78 in the seal sub 24 can be any suitable mechanism such as are known in the art. Although the seal sub 24 is preferably hydraulically retracted, other apparatus and methods well known in the art may be used to actuate seal sub 24. Although seal sub 24 does not positively connect riser joint 20 to small diameter riser 40, a hydraulically actuated connector, well known in the art, may be used to positively connect riser joint 20 to riser 40.

Referring again to FIGS. 1 and 2, to run a new casing string 98 or other equipment having a larger diameter than small diameter riser 40 into the wellbore 12, valve 26 and BOP stack 18 are closed and seal tube 78 is retracted into seal sub 24. Valve 26 remains closed as long as small diameter riser 40 is in the shifted position shown in FIG. 2. The new casing string 98 may or may not have been assembled and be suspended adjacent small diameter riser 40. Shifter 50 is actuated by hydraulically actuated cylinders 54, 56 causing piston members 70, 72 to extend from cylinders 54, 56 pushing choke, kill, and booster lines 30 away from riser joint 20 and causing lines 30 to separate from riser joint 20. Because riser joint 20 is much stiffer than choke, kill, and booster lines 30, choke, kill, and booster lines 30 will tend to deflect away from riser joint 20 which remains substantially vertical. As choke, kill, and booster lines 30 deflect and bend away from riser joint 20, the upper ends of lines 30 connected to the lower end of small diameter riser 40 are shifted laterally away from the upper of riser joint 20 by a distance approximately equal the extension of piston members 70, 72. The lateral shifting of lines 30 shifts small diameter riser 40 out of its normal alignment with riser joint 20. With riser 40 out of the way, new casing string 98 and/or other large diameter equipment, which would not fit through riser 40, can be lowered into the wellbore 12.

As shown in FIG. 2, the shift of small diameter riser 40 to one side of riser joint 20 causes small diameter riser 40 to move off line with the wellbore 12 and particularly with the axis 44 of riser joint 20. This permits the new casing string 98 to be aligned with the riser joint 20. It should be appreciated that the small diameter riser 40 and new casing string 98 are simultaneously being manipulated at the surface to move the upper ends of small diameter riser 40 and new casing string 98 to accommodate the offline movement of small diameter riser 40 and the alignment of new casing string 98.

A guide funnel 100 may be mounted to a frame 102 on valve 26 to guide the new casing string 98 into the open upper end of riser joint 20. The funnel is full of sea water. It can be seen that as the top of choke, kill, and booster lines 30 with valve 26 and frame 102 are shifted, guide funnel 100 is brought into alignment with the end of riser joint 20. New casing string 98 is then stabbed into funnel 100 which guides the lower end of the new casing string 98 into riser joint 20.

Funnel 100 helps protect the seal surface of seal bore 90 inside the seal sub 24. Without funnel 100, stabbing the new casing into that seal bore 90 could damage the sealing surface and prevent the formation of a seal when the riser 40 shifted back over riser joint 20 and reconnected. The funnel ID is preferably the same as the ID of the riser joint 20 and smaller than the ID of the seal bore 90 in the seal sub 24.

The new casing string 98 is stripped through annular BOP 18*a*. Passage of the casing connections through the stripper may cause some leakage. However, this leakage is tolerable, particularly if the drilling mud is water based and environmental friendly. It is desirable to minimize the pressure differential across the annular BOP through which the new casing is being stripped. The higher the pressure differential, the greater the risk of problems such as loss of fluid or damage to the annular BOP packer. It may be preferable to have two annular BOPS 18*a* whereby the casing and casing connectors are first stripped through the upper BOP and then stripped through the lower BOP. The operational sequence includes opening the upper BOP to receive the coupling, closing the upper BOP and then opening the lower BOP to continue stripping the new casing string into the well. The opening and closing of the BOPs is hydraulically operated.

The new casing string 98 typically includes a shoe 104 on the lower end of the casing string 98. Various types of shoes may be used. Some are automatic filled which allows fluid to continuously back flow. The most simple type is a check valve which does not allow fluid to flow into the end of the new casing string 98 but does allow fluid in the new casing string 98 to flow out. A cement plug may also be used in accordance with the present invention although a shoe is preferred.

As best shown in FIG. 2, upper and lower flex joints 28, 22 permit the axes 44, 31 of riser joint 20 and choke, kill, and booster lines 20, respectively, to deviate from the axis 13 of wellbore 12. In particular, as lines 30 are shifted, there will be a flexure at the connection upper flex joint 28 between valve 22 and small diameter riser 40. According to one preferred embodiment, the axis 31 of lines 30 and the axis 42 of small diameter riser 40 form an angle of approximately 7° in the shifted position as shown in FIG. 2. This angle is determined by the length of lines 30 and the lateral distance which lines 30 are moved to provide sufficient set-aside for small diameter riser 40 so as to provide adequate clearance for the stabbing of the new casing string 98 into riser joint 20. There will only be an angle formed at lower flex joint 14 if the floating vessel is not directly over the top of the wellhead. If there is a deviation, it is preferably corrected by repositioning the drilling vessel to bring the riser back to a straight condition.

Although BOP stack 12 is closed while the small diameter riser 40 is shifted out of position, the choke, kill, and booster lines 30 communicate with the wellbore 12 via a side outlet in the BOP stack 12 and therefore remain in hydraulic communication with the wellbore 12 throughout the operation. Small diameter riser 40 remains filled with well fluids and the fluid column in riser 40 remains even while small diameter riser 40 is off center as shown in FIG. 2.

A fluid column from the surface to the wellhead 14 is maintained on the wellbore 12 for well control purposes throughout the installation of the over-sized casing string 98 or other well equipment. The fluid column forms a hydrostatic head which exerts a hydrostatic pressure on the subsurface formations to maintain the well under control at all times during the installation including particularly the disconnection of the small diameter riser 40 from the riser joint 20. Although the closure of valve 26 closes communication between the fluid column in the small diameter riser 40 and the wellbore through riser joint 20, choke, kill, and booster lines 30 bypass valve 26 and continue to provide a fluid connection to the fluid column in the riser 40. The column thus extends from the wellbore 12, through lines 30 and small diameter riser 40 to the surface thereby maintaining the head on the wellbore 12.

In an alternative embodiment, choke, kill, and booster lines 30 may extend from the wellhead 14 all the way to the surface adjacent small diameter riser 40. Regardless of whether choke, kill, and booster lines 30 flow into the lower end of riser 24 or extend to the surface, they provide hydraulic continuity all the way to the surface. Hence, hydraulic communication between the well and the surface is maintained throughout the entire operation. Tension is maintained by providing a mechanical connection, such as one or more metal members, extending between the wellhead 14 and the lower end of small diameter riser 40.

It should be appreciated that choke, kill, and booster lines 30 may be used for circulation or pressure control during well operations including during the installation of the new casing string 98. For example, if the well begins to absorb drilling fluids, the fluids can be replenished via lines 30, thereby avoiding a dangerous loss of hydrostatic pressure in the well. In addition, as the new casing string 98 is run into the wellbore 12, it will displace fluids in the well. According to the present invention, this displaced fluid can be removed from the well through choke, kill, and booster lines 30 and, preferably, through small diameter riser 40.

The present invention provides many advantages. One primary advantage of the present invention is that it is not necessary to disconnect fluid communication with the small diameter riser 40 in order to run in the new casing string 98. The choke, kill, and booster lines 30 provide hydraulic control at all times. In addition, the BOP stack 18 remains connected throughout the operation. Thus, the present invention provides continuous control of the well.

Another advantage is that the new casing string 98 may be aligned directly over the wellbore 12 such that no dogleg is presented for inserting the new casing string 98. Although a dogleg is formed in choke, kill, and booster lines 30 after being shifted to one side, nothing is run through the lines 30 so that dogleg does not present a problem. Hence, the new casing string 98 can be run straight into the well. Although there may be a slight deflection in riser joint 20 due to the biasing of lines 30, this deflection is very small and will not adversely affect the installation. Also, in the drilling mode, with the small diameter riser 40 aligned over the well bore 12, the drill string may be operated directly over the wellhead, i.e. is co-axial.

Still another advantage is that the new casing string 98 can be installed during inclement weather. A further advantage of the present riser system 10 is that it does not require the small diameter riser 40 to be raised or lowered.

In the following Example, one use of the present system is described with respect to exemplary well and equipment dimensions.

In drilling a subsea well, a large conductor string, which may be 30 inch or 36 inch pipe, is either jetted into the subsea floor 16 or a borehole is drilled. This is all performed in open water and no riser is used. Sea water is used for the drilling. The 30 inch casing may extend 300 to 600 feet into the ground and typically 5 or 6 feet of the 30 inch conductor casing extends above the mud line 16.

If a bore hole is drilled, then the conductor casing is cemented by pumping cement down the conductor casing and up the annulus. The cement flows out of the annulus over onto the seabed 16. The next casing is typically 20 inch casing, although sometimes there may be an intermediate string outside the 20 inch casing. A 26 inch bit is used to drill through the cement in the conductor casing and to drill a new 26 inch borehole. The 20 inch casing may extend 1,500 to 2,000 feet into the ground. The 20 inch casing is often referred to as the surface casing. The drilling is again done in open water with no riser attached. Drilling with the 26 inch bit is done with sea water and the returns merely flow out onto the sea bed 16. The 20 inch casing is then run into the borehole with the wellhead housing 14 on top. The wellhead housing 14 is landed within the 30 inch conductor casing.

After the 20 inch casing has been cemented into place, the BOP stack 18 and riser joint 20 are then lowered to the mud line 16 and connected to the wellhead housing 14. The wellhead housing 14 has a hub for the attachment of the BOP stack 18. A collet connector attaches the wellhead housing 14 to the BOP stack 18. Alternatively, the BOP stack 18 may be attached and deployed with the riser system 10 which is attached to the small diameter riser 40.

In order to gain the advantages described hereinabove, the riser system 10 of the present invention is then assembled.

By way of example, riser joint 20 can have a 21 inch OD and an 18-¾ inch ID, while choke, kill, and booster lines 30 typically have an inside diameter of 4 inches. Riser joint 20 is preferably at least 21 inch pipe so that all subsequent casing strings, including the 16 inch casing and 13-⅜ inch casing, can be run through riser 20 and into the wellbore 12. It will be appreciated that the casing sizes and number of casing strings will vary with the well. Not only must the casing strings be run through riser joint 20, but also their corresponding casing hangers which have a diameter which is larger than the diameter of the casing.

In the present example, the small diameter riser 40 extends from the top of riser joint 20 to the surface and preferably has a 16 inch outside diameter and a 13-⅝ inch inside diameter.

In lowering the riser system 10 from the platform on the floating vessel down to the BOP stack 18, riser joint 20 must be aligned for connection to the top of the BOP stack 18. If the rotary table is big enough, the riser joint 20 will pass down through the rotary table. For example, the funnel 100 and cylinders 54, 56 may have to be attached below the rotary table. The flex joints 22, 28 should be able to pass through the rotary table. The hole through the rotary table is at least 47 inches and often 49 inches in diameter. In some of the large rigs, the rotary table is 60 inches. With the riser system 10 in place, tension from the drilling vessel is placed on the small diameter riser 40 and choke, kill and booster lines 30. Typically the tension is in the range of about 50,000 pounds up to 500,000 pounds, which is well within the range of acceptable tension loads for lines 30.

With riser system 10 in place, a drill bit for drilling a 17 inch or 17-½ inch extended borehole is then lowered through small diameter riser 40 on a drill string. The bit must be of a design which will allow it to pass through small diameter riser 40 and then once in the borehole 12, is able to drill a borehole large enough to accommodate the next casing string to be installed in the wellbore 12. For example, a 12-¼ inch bit with a hole opener can be used to drill the new borehole. This allows the bit to pass through the small diameter riser 40 and yet drill a borehole large enough to receive a 16 inch casing string. The hole opener can drill a bore with a diameter of 17-½ inches or larger if desired. Alternatively, a bi-center bit can be used.

During normal drilling operations, drilling fluid is pumped into the well through the drill string and returns flow to the surface through the annulus around the drill string . The outer wall of the annulus is defined by the borehole or casing below the well head 14, riser joint 20 between the wellhead 14 and valve 26, and by small diameter riser 40 between valve 26 and the surface. The length of the casing can be anywhere from 2,500 to 7,000 feet long for this size casing. The entire length of casing must be stripped through the BOP 18.

Once the new borehole is drilled, because the 16 inch casing and 13-⅜ inch casing will not fit through the 13-⅝ inch ID of the small diameter riser 40, the riser 40 is set aside to gain access to the larger diameter wellbore 12. The drill string need not be completely retrieved from the small diameter riser 40 but only need be raised up to a point where the bit is located in the lower end of riser 40. Valve 26 and BOP stack 18 are then closed. The seal tube 78 in seal sub 24 is hydraulically retracted from the counterbore of receptacle 92 at the top of the riser joint 20. Hydraulic cylinders 54, 56 are actuated to shift the choke, kill, and booster lines 30 off center axis 44.

With the riser 40 shifted to the side, the funnel 100 is aligned with the top of the riser joint 20. The funnel 100 provides a large opening into which to stab the casing string. The counterbore in receptacle 92 has an ID greater than 19 inches. The ID of the funnel 100 is also 19 inches. The ID of the counterbore is typically approximately 1 ½ inchs larger than the ID of the riser joint 20.

In some instances, the new casing can be fully assembled and lowered and dangling beside the riser as the riser is moved to one side. A dual activity rig is necessary for simultaneous drilling and assembly of the new casing string. The dual activity rig has the ability to suspend a riser string and also assemble and lower the new casing beside the suspended riser using a second rotary table draw works. This will allow the new casing string to be assembled and lowered even while drilling through the riser before it is moved to one side.

If the drilling vessel is a dual activity vessel, the new casing string 98 can be assembled and lowered concurrently with drilling the last stages of the new borehole. The new casing string can be suspended beside the small diameter riser 40. It is preferably suspended at an elevation just above funnel 100. This can be done while drilling the borehole for the new casing. If a dual activity rig is not available, the steps have to be performed sequentially.

The new casing string 98 is preferably filled either with water or drilling mud as it is assembled and lowered into the water towards the wellhead 14. The new casing string 98 is not buoyant and will not float since it is at least filled with water. If the new casing is filled with drilling mud, there will be a head placed on the shoe at the bottom of the casing. More typically, it will be filled with water.

The 16 inch casing string 98 is then stabbed into the top of casing guide funnel 100. The casing string 98 is lowered through funnel 100 and run all the way into the wellbore 12. The casing hanger at the top of the 16 inch casing string lands in the wellhead 14 below the blowout preventer stack 18. The seal assembly is disposed and actuated between the casing hanger and wellhead. The seal assembly in the wellhead is tested by closing the BOP stack.

After the test is completed, the BOP stack 18 is opened again. The running tool is then released from the newly run casing hanger. The running tool and drill string are then pulled out of the hole. The hydraulic cylinders 54, 56 are retracted and the seal sub 24 is hydraulically actuated to again be received within the counterbore in the top of riser joint 20 as shown in FIG. 1.

If the drilling fluids in the small diameter riser 40 were displaced with sea water prior to moving the riser 40 off center as shown in FIG. 2, then the column of mud in the well which had been made more dense to make up for the lighter sea water density in the riser 40 will begin to rise up through the choke, kill, and booster lines 20 during cementing. The heavier mud is going to place a higher pressure on the well which may need it to be lightened up. This high pressure may need to be lifted off of the well by circulating out the high density mud. This circulation would typically occur up through the choke, kill, and booster lines 30. Alternatively, it is possible to circulate from the BOP stack 18 to the surface by passing fluid through the booster lines 66, 68. During the cementing operation, the returns pass up either through the choke, kill, and booster lines 30 or booster lines 66, 68.

During drilling, the riser joint 20, as shown in FIG. 1, is full of drilling fluid. With respect to FIG. 2, whether the drilling fluids in the small diameter riser 40 are displaced with sea water depends upon how the overflow is going to be dealt with when the new casing string 98 is run into the well. As the new casing string 98 is run in, it will displace fluid already in the well and this fluid must be removed from the well. There is also a displacement of fluids in the well as the casing string 98 is cemented into the well. The displaced fluid may be removed by circulating it out in batches. Continuous circulation is also possible. Further, it may be possible for the displaced fluids to flow up to the surface.

The drilling operation can then be begun for the next size casing and the foregoing process is repeated one more time for the 13-⅜ inch casing string. After the 13-⅜ casing, the next casing is typically 10-¾ inch casing, which can pass through the small diameter riser 40. Thus, for the 10-¾ inch and smaller casings, the small diameter riser 40 remains in position over the wellhead assembly 14 and the drilling and cementing follows conventional procedures.

Because it is preferred that the casing hangers for the 10-¾ casing and smaller pass through small diameter riser 40, a particular wellhead system 14 is required. In a conventional wellhead system, all of the casing hangers may have an outside diameter of 18-½ inches and are supported by the wellhead housing. They also have a seal assembly of the same size to seal between the casing hanger and the wellhead housing. However to pass the casing hangers through the smaller diameter riser 40, it is necessary that the casing hangers have a smaller diameter. Thus, in the present invention, the casing hangers are nested inside each other for the 10-¾ inch and smaller casing strings. Wellhead systems are available where the casing hangers fit inside the previously run casing hanger and the seal assemblies seal between adjacent casing hangers. Thus, for example, the 13-⅜ inch casing hanger would have a long counterbore serving as a seal bore for the later installed hangers. It has a smaller seal bore which will accommodate a smaller casing hanger that will pass through the small diameter riser 40.

While a preferred embodiment of the invention has been shown and described, modifications thereof can be made by one skilled in the art without departing from the spirit of the invention.

What is claimed is:

1. A riser system extending between a wellhead assembly on a sea floor and a floating vessel at the surface, the wellhead assembly having a bore therethrough, comprising:

a riser adapted for releasable connection to the wellhead assembly; and at least one stress member connected to said riser and adapted for connection with the wellhead assembly.

2. The system of claim 1 wherein said riser has an inner bore smaller in diameter than the bore of the wellhead assembly.

3. The system of claim 1 whereby said stress member provides fluid communication to the wellhead assembly bore when said riser is disconnected from the wellhead assembly.

4. The system according to claim 1 further including a shifter to move said riser off center of the wellhead assembly.

5. The system according to claim 1 further including a valve member disposed on one end of said riser.

6. The system according to claim 1 further including a riser joint having a flowbore substantially the same as the wellhead assembly bore, said riser joint having one end adapted for connection to the wellhead assembly and the other end connected to said riser.

7. The system according to claim 6 wherein said riser has an inside diameter that is smaller than that of said riser joint.

8. The system according to claim 1 further including means for moving said riser off center of the wellhead assembly bore.

9. The system according to claim 8 wherein said means is an extendable member affixed between said riser joint and said stress member.

10. The system according to claim 9 wherein said extendable member shifts said riser from a coaxial position with said riser joint to a non-axial position with said riser joint, said stress member in fluid communication with the wellhead assembly in said non-axial position.

11. The system according to claim 9 wherein said stress member transfers tension on said riser after said riser is released from said riser joint.

12. The system according to claim 9 further including a guide that aligns with said riser joint after said riser is released and moves laterally from said riser joint.

13. The system according to claim 1 further including a flexible joint between said fluid conduit and said riser.

14. The system according to claim 1 wherein said riser is sealingly connected to said riser joint by a stab seal connection.

15. The system according to claim 3 wherein said stress member comprises choke and kill lines.

16. The system according to claim 3 wherein said stress member comprises booster lines.

17. The system according to claim 1 wherein said stress member transfers tension from said riser to the wellhead assembly.

18. A method for installing one or more strings through a bore of a BOP stack on a subsea well, comprising:

sealingly connecting a riser to the BOP stack;

providing fluid communication to the BOP stack bore exteriorly of said riser;

drilling a borehole in the well;

disconnecting the riser from the BOP stack;

moving the riser to provide access to the BOP stack bore;

maintaining fluid communication to the BOP stack bore while the riser is disconnected;

maintaining tension through a stress member while said riser is disconnected from the BOP stack;

lowering a casing string having an outer diameter greater than the inside diameter of the riser but smaller than the inside diameter of the BOP stack; and passing the casing string through the BOP stack bore.

19. The method of claim 18 wherein the riser comprises an inner bore smaller in diameter than the bore of the subsea well assembly.

20. The method of claim 18 further comprising maintaining tension between the riser and BOP stack through a stress member while riser and BOP stack are disconnected.

21. The method of claim 18 further comprising closing the riser and the BOP stack prior to disconnecting the riser.

22. The method of claim 18 further comprising a fluid conduit for providing the fluid communication.

23. The method of claim 22 further comprising connecting a riser joint between the BOP stack and the riser.

24. The method of claim 23 further comprising forcing the riser joint and conduit apart to move the riser.

25. A method for casing a wellbore, the casing having a casing diameter, comprising:

(a) providing a main riser having a main inner diameter that is larger than the outer casing diameter;

(b) providing an upper riser, the upper riser releasably connected to the main riser and including a flow closing device at its lower end;

(c) providing a stress member to the wellbore;

(d) releasing the upper riser from the main riser and shifting it; and (e) running casing into the well through the main riser while maintaining fluid communication with the well.

26. The method according to claim 25 further comprising maintaining tension in the upper riser through the stress member.

27. The method according to claim 25 wherein a fluid communication line extends through the stress member.

28. The method according to claim 25, further including the step of closing the lower end of the upper riser before releasing the upper riser from the main riser.

29. The method according to claim 25, further including providing an extendable member affixed between the main riser and the stress member.

30. The method according to claim 25 wherein said stress member maintains tension on said upper riser when said upper riser is released from the main riser.

31. The method according to claim 25, further including providing a guide that aligns with the main riser when the upper riser is released from the main riser and shifted laterally.

32. The method according to claim 25, further including providing a flexible joint between the stress member and the upper riser.

33. The method according to claim 25 wherein the upper riser is releasably connected to said main riser by a stab seal connection.

34. The method according to claim 25 wherein the stress member comprises choke and kill lines.

* * * * *